US012291837B2

(12) United States Patent
Lauterslager

(10) Patent No.: US 12,291,837 B2
(45) **Date of Patent: *May 6, 2025**

(54) COUPLING ASSEMBLY AND METHOD OF HYDRAULICALLY COUPLING TO A TOOL

(71) Applicant: Caterpillar Inc., Deerfield, IL (US)

(72) Inventor: Peter Lauterslager, Oss (NL)

(73) Assignee: Caterpillar Inc., Peoria, IL (US)

( * ) Notice: Subject to any disclaimer, the term of this patent is extended or adjusted under 35 U.S.C. 154(b) by 1003 days.

This patent is subject to a terminal disclaimer.

(21) Appl. No.: 17/303,786

(22) Filed: Jun. 8, 2021

(65) Prior Publication Data

US 2021/0292992 A1 Sep. 23, 2021

Related U.S. Application Data

(62) Division of application No. 16/442,916, filed on Jun. 17, 2019, now Pat. No. 11,053,660.

(51) Int. Cl.

| | |
|---|---|
| ***E02F 3/36*** | (2006.01) |
| ***E02F 3/96*** | (2006.01) |
| *E02F 3/413* | (2006.01) |

(52) U.S. Cl.

CPC ..... *E02F 3/3627* (2013.01); *E02F 3/3654* (2013.01); *E02F 3/3663* (2013.01); *E02F 3/963* (2013.01); *E02F 3/4133* (2013.01)

(58) Field of Classification Search

CPC ..... E02F 3/3627; E02F 3/3654; E02F 3/3663; E02F 3/963; E02F 3/4133; E02F 3/3604; E02F 3/3609; E02F 3/3613; E02F 3/3618; E02F 3/3622; E02F 3/3631; E02F 3/364; E02F 3/3659

See application file for complete search history.

(56) References Cited

U.S. PATENT DOCUMENTS

| | | | |
|---|---|---|---|
| 3,243,066 | A | 3/1966 | Gardner |
| 4,738,463 | A | 4/1988 | Poore |
| 4,955,779 | A | 9/1990 | Knackstedt |
| 5,465,513 | A | 11/1995 | Sonerud |
| 5,769,596 | A | 6/1998 | Burton |
| 5,890,871 | A | 4/1999 | Woerman |
| 6,196,595 | B1 | 3/2001 | Sonerud |
| 6,379,075 | B1 | 4/2002 | Shamblin |

(Continued)

FOREIGN PATENT DOCUMENTS

| | | |
|---|---|---|
| EP | 2466182 A1 | 6/2012 |
| EP | 3680393 | 7/2020 |

(Continued)

*Primary Examiner* — Jamie L McGowan

(57) ABSTRACT

A method of coupling a tool to a work machine including inserting a front lug of a coupling assembly into a front recess on the tool, inserting a rear lug of the coupling assembly into a rear recess on the tool, moving a retaining member of the coupler assembly to a retaining position relative to the tool to releasably mount the tool to the work machine, while simultaneously preventing movement of a hydraulic coupling manifold on the coupling assembly from moving; and moving the hydraulic coupling manifold to a coupling position with a hydraulic power transmission coupling on the tool to hydraulically couple the tool to the work machine in response to the retaining member reaching the retaining position.

10 Claims, 13 Drawing Sheets

(56) References Cited

U.S. PATENT DOCUMENTS

| | | | | |
|---|---|---|---|---|
| 7,464,967 | B2 | 12/2008 | Mieger | |
| 7,654,019 | B2 | 2/2010 | Yeager | |
| 7,654,787 | B2 | 2/2010 | Sonerud | |
| 7,735,249 | B2 | 6/2010 | Muller | |
| 7,963,054 | B2 | 6/2011 | Wimmer | |
| 8,347,974 | B2 | 1/2013 | Calvert | |
| 8,602,676 | B2 | 12/2013 | Stollery | |
| 9,377,146 | B2 | 6/2016 | Van Hooft | |
| 9,970,177 | B2 | 5/2018 | Koestler | |
| 11,053,660 | B2 * | 7/2021 | Lauterslager ..... | E02F 3/963 |
| 2014/0321956 | A1 | 10/2014 | Frey | |
| 2019/0177946 | A1 | 6/2019 | Jo | |
| 2020/0002913 | A1 | 1/2020 | Kollmann | |
| 2020/0217040 | A1 | 7/2020 | Hill | |
| 2020/0299921 | A1 | 9/2020 | Sieber | |
| 2020/0392691 | A1 | 12/2020 | Lauterslager | |

FOREIGN PATENT DOCUMENTS

| | | | |
|---|---|---|---|
| GB | 2474573 | A | 4/2011 |
| NL | 1017043 | | 7/2002 |
| WO | 2010062166 | | 6/2010 |
| WO | 2012080213 | A1 | 6/2012 |
| WO | 2014098618 | A1 | 6/2014 |

* cited by examiner

COUPLING ASSEMBLY AND METHOD OF HYDRAULICALLY COUPLING TO A TOOL

TECHNICAL FIELD

This disclosure relates to coupling assembly, commonly referred to as quick coupler, for attaching a tool to a machine, and in particular to a coupling assembly having a hydraulic manifold and a method for hydraulically coupling the work tool to the machine.

BACKGROUND

Wheeled or tracked machines such as excavators and backhoe loaders are commonly configured to operate a variety of interchangeable tools such as buckets, grabs, breakers, compactors and the like. Each tool is releasably mounted on a rigid mount attached to the machine so as to transmit forces between the tool and the machine in use. The mount forms part of a coupling assembly, commonly referred to as a quick coupler because it makes it easy to connect and disconnect the tool. The quick coupler includes a rigid retaining body movable by one or more actuators, typically hydraulic actuators, between a release position and a retaining position in which the tool is engaged by retaining portions of the retaining body to retain it in fixed relation to the mount. Some work tools include hydraulic actuators used to actuate the work tool. Hydraulic lines from the machine are connected to the work tool so that the hydraulic system on the machine may power the actuators. Some quick coupling systems may include hydraulic connections for connecting the hydraulic system on the machine to the work tool.

For example, U.S. Pat. No. 7,735,249, entitled "Quick-change device," discloses a quick coupler fastened on the machine, an adapter which can be locked with the quick coupler and is connected to the tool, and a hydraulic coupling for producing a hydraulic connection between the hydraulic system on the machine and the hydraulics of the tool. The hydraulic coupling includes a first coupling part and a second coupling part mounted on the front of the quick coupler and adapter, respectively. The two coupling parts are held frictionally in the operating position, relative to one another, by the mechanical retaining means.

SUMMARY

In accordance with the present disclosure there is provided a coupling assembly for releasably mounting a tool on a work machine.

In accordance with one aspect of the present disclosure, a method of coupling a tool to a work machine includes inserting a front lug of a coupling assembly into a front recess on the tool, inserting a rear lug of the coupling assembly into a rear recess on the tool, moving a retaining member of the coupler assembly to a retaining position relative to the tool to releasably mount the tool to the work machine, while simultaneously preventing movement of a hydraulic coupling manifold on the coupling assembly from moving, and moving the hydraulic coupling manifold to a coupling position with a hydraulic power transmission coupling on the tool to hydraulically couple the tool to the work machine in response to the retaining member reaching the retaining position.

In accordance with another aspect of the present disclosure, a method of decoupling a tool from a work machine includes moving a hydraulic coupling manifold on a coupling assembly from a coupling position in which the tool is hydraulically coupled to the work machine to a decoupling position in which the tool is hydraulically decoupled from the tool and moving a retaining member on the coupling assembly to a release position in response to the hydraulic coupling manifold reaching the decoupling position.

In accordance with another aspect of the present disclosure, a coupling assembly for releasably mounting, and hydraulically coupling, a tool to a work machine includes a mount attachable to the work machine and configured to receive the tool in a mounted position of the tool, a rigid retaining body movable in translation relative to the mount along a translation axis between a retaining position for retaining the tool to the mount and a release position for releasing the tool from the mount, a first and a second actuator operable to move the retaining body between the retaining and release positions, a hydraulic coupling manifold movable in translation relative to the mount along the translation axis for hydraulically coupling the tool to the machine, wherein the hydraulic coupling manifold uses the first and second actuators as guides for moving along the translation axis, and a control valve configured to prevent movement of the retaining body from the retaining position to the release position unless the hydraulic coupling manifold is in the decoupling position.

BRIEF DESCRIPTION OF THE DRAWINGS

Further features and advantages will be evident from the following illustrative embodiment which will now be described, purely by way of example and without limitation to the scope of the claims, and with reference to the accompanying drawings, in which:

DETAILED DESCRIPTION

In this specification, a work machine means any machine, such as a fixed or mobile machine, which is configured to manipulate and operate a tool mounted on the machine. The machine may perform some type of operation associated with an industry such as mining, construction, farming, transportation, or any other industry known in the art. For example, the work machine 1 may be an earth moving machine such as an excavator (shown in FIG. 1), a backhoe, a loader, material handler, or any other earth moving machine.

Figure 1:
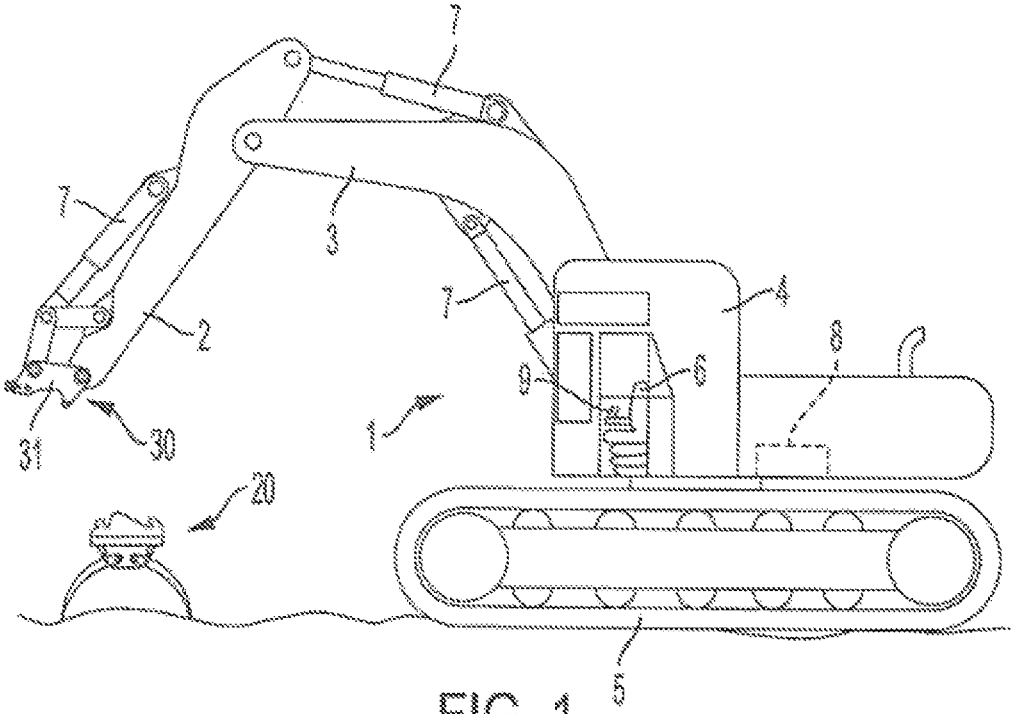
FIG. 1 is side view of a work machine having a coupling assembly and a tool detached from the coupling assembly.

Referring to FIG. 1, an illustrated embodiment of a coupling assembly 30 includes a rigid mount 31 pivotably attached to a distal end of an arm or stick 2 of a work machine 1. In the illustrated embodiment, the work machine 1 is configured as a tracked excavator having a machine body or house 4 rotatably mounted on tracks 5 and containing a seat 6 for the operator. The stick 2 is pivotably mounted at the distal end of another arm or boom 3, which in turn is pivotably mounted on the body 4. One or more actuators 7 are arranged to move the stick 2, the boom 3 and the mount 31 by hydraulic pressure from a source such as an engine driven hydraulic pump 8 responsive to commands received from the operator via one or more user controls 9, such as for example, a joystick.

Figure 2:
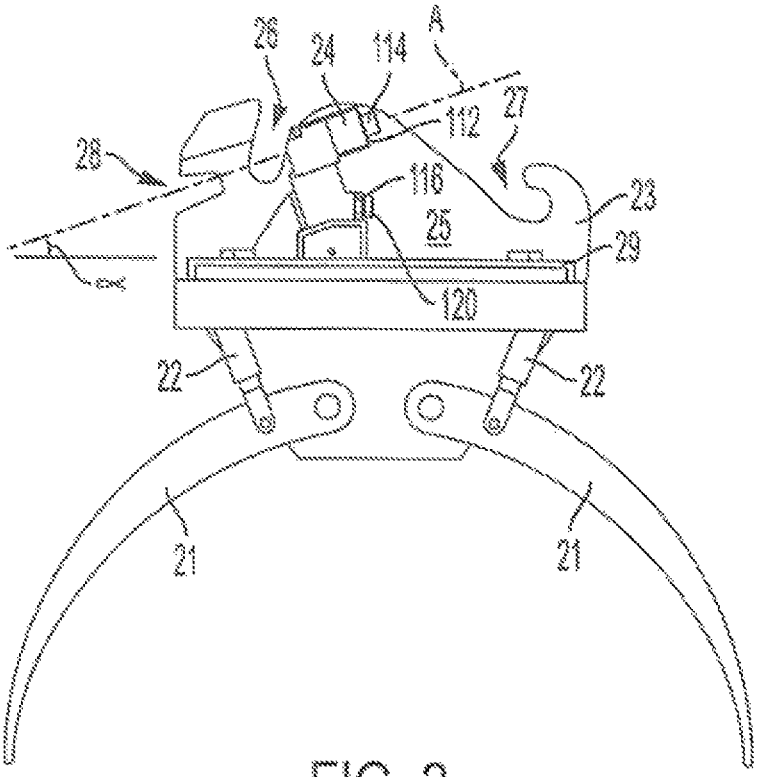
FIG. 2 is a side view of the tool.
Figure 3:
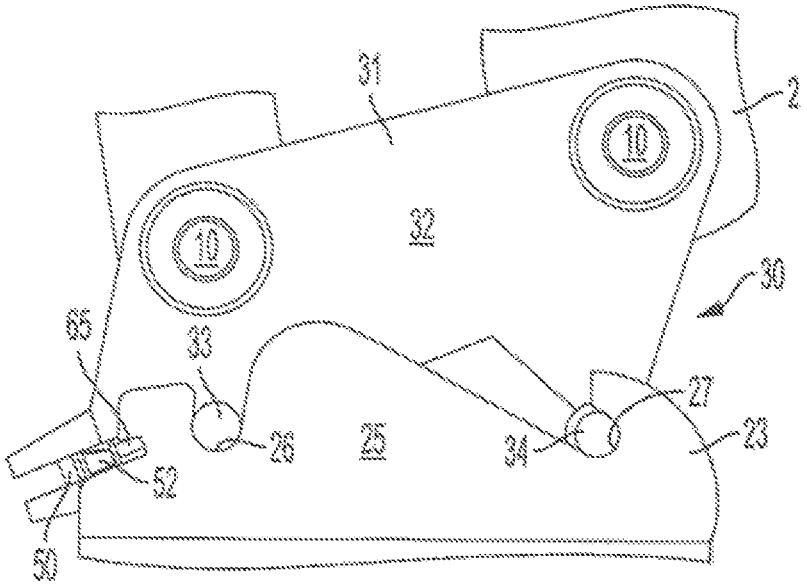
FIG. 3 is a side view of the tool received in the mounted position on the coupling assembly with a retaining body of the coupling assembly in the release position.

Referring to FIGS. 2-3, an illustrated embodiment of a tool 20 is configured as a grab with arms 21. In other embodiments, however, the tool 20 may be any hydraulically-actuatable tool. The arms 21 are actuatable by hydraulic actuators 22 on the tool 20 responsive to hydraulic pressure which is transmitted from the hydraulic pump 8 to the tool 20 via a hydraulic power transmission coupling 24, described in more detail below. The tool 20 may include a tool bracket 23 configured to be releasably mounted to the coupling assembly 30. The tool bracket 23 may be integrally formed with the tool 20 or attached to the tool 20 by any suitable means, such as for example, welding or fasteners. The tool bracket 23 may include the hydraulic power transmission coupling 24 and structure to releasably mount to the coupling assembly 20 to form a coupling arrangement. In the illustrated embodiment, the tool bracket 23 includes two parallel side plates 25 (one of which has been removed in FIG. 2 to show the hydraulic power transmission coupling 24, the other being a mirror image) and a base 29 extending between the side plates 25. In the illustrated embodiment, the base 29 extends perpendicular to the side plates 25. In other embodiments, however, the base 29 may not extend perpendicular to the side plates 25. Each of the side plates 25 define a front recess 26, a rear recess 27, and a wedge receptacle 28.

Figure 5:
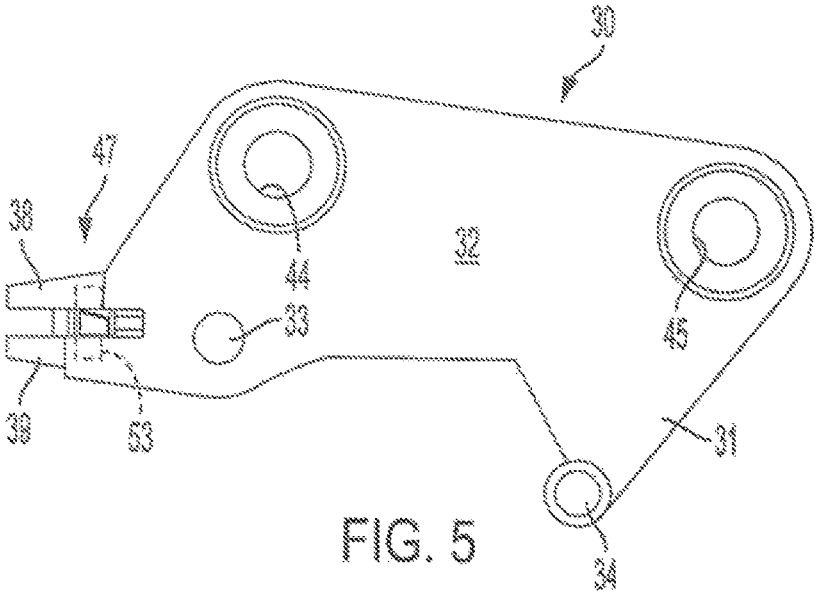
FIG. 5 is a side view of the coupling assembly with the retaining body in the release position.
Figure 9:
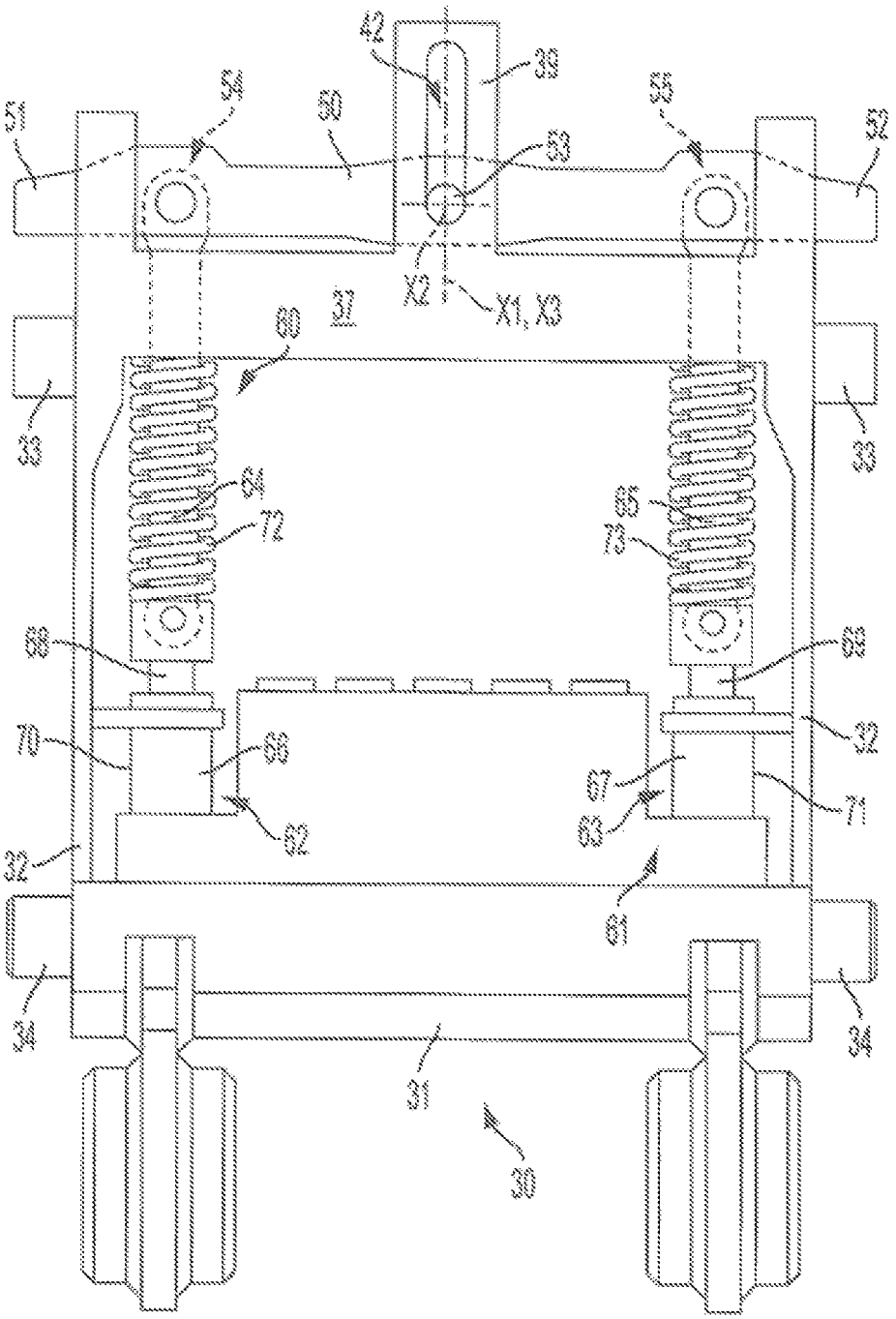
FIG. 9 is a bottom view of the coupling assembly showing the retaining body in the retaining position.

Referring to FIGS. 5 and 9, the mount 31 may be configured as a rigid steel casting or fabrication having parallel side plates 32 connected by a central portion 37 and supporting outwardly and oppositely projecting front lugs 33 and rear lugs 34. At the forward end of the mount 31, each side plate 32 may define an upper guide surfaces 35 and an opposed, spaced-apart, lower guide surface 36 (FIG. 6).

Figure 6:
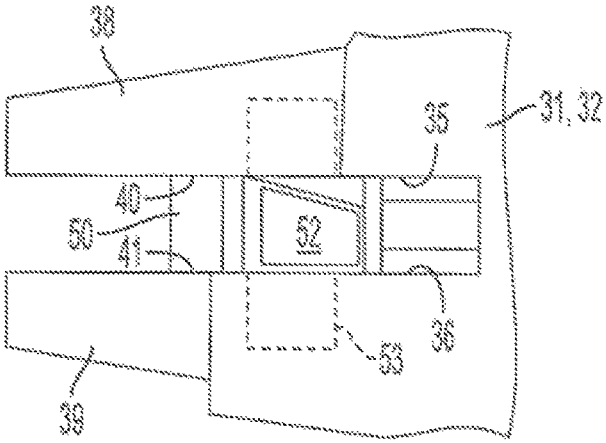
FIG. 6 is an enlarged partial side view of the coupling assembly, showing the retaining body in the release position.
Figure 8:
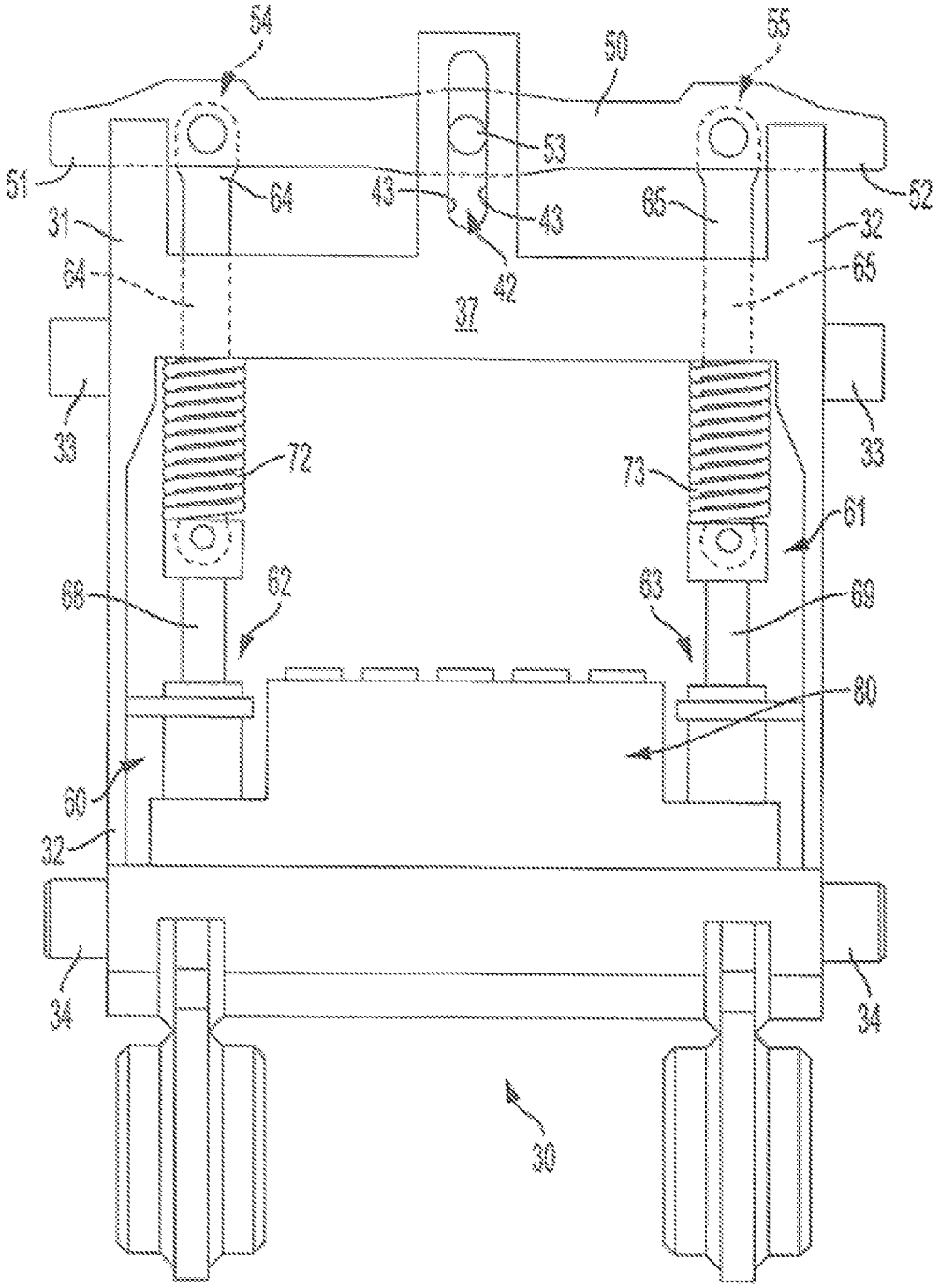
FIG. 8 is a bottom view of the coupling assembly showing the retaining body in the release position.

The central portion 37 of the mount 31 includes a first portion 38 and an opposed second portion 39 that extend from a forward end 47 of the mount 31 along a longitudinal central axis X1 mid-way between the side plates 32 to define a second upper guide surface 40 and an opposed, spaced-apart, second lower guide surfaces 41 (FIG. 6). The coupling assembly 30 may include a pair of slots 42, one in each of the first portion 38 and the opposed second portion 39, to extend along the longitudinal central axis X1 and open through the respective one of the second upper and lower guide surfaces 40, 41. The opposed walls of each slot 42 may be exactly superposed in plan view and may define another pair of opposed third guide surfaces 43 which extend in spaced relation in parallel with the central longitudinal axis X1 (FIG. 8).

Each side plate 32 may also define a front mounting hole 44 and a rear mounting hole 45 through which front and rear pins 10 are inserted to attach the mount 31 to the stick 2 of the work machine 1. The coupling assembly 30 includes a rigid retaining body 50 for attaching the coupling assembly 30 to the tool 20. The mount 31 may be configured as a housing in which the rigid retaining body 50 is arranged to be movable relative to the mount 31 between a retaining position as shown in FIGS. 4, 7 and 9 and a release position as shown in FIGS. 3, 5, 6 and 8.

The retaining body 50 may be configured in a variety of ways. In the illustrated embodiment, the retaining body 50 is configured as an elongate solid bar, with its opposite end regions defining a first retaining portion 51 and a second retaining portion 52. In use, the first retaining portion 51 and the second retaining portion 52 may directly engage the tool bracket 23 and may extend outwardly of the side plates 32 on each side of the mount 31 as shown in FIG. 8.

Figure 7:
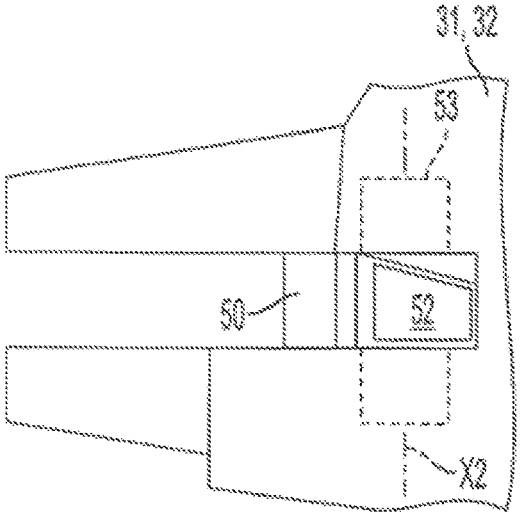
FIG. 7 is an enlarged partial side view of the coupling assembly, showing the retaining body in the retaining position.

The first retaining portion 51 and a second retaining portion 52 may be slidably received between the upper guide surface 35 and the lower guide surfaces 36 (FIG. 7). When considered in end view, as best seen in FIGS. 6-7, each of the first retaining portion 51 and the second retaining portion 52 may be shaped to form a wedge which may taper towards the rear end of the mount 31.

Figure 4:
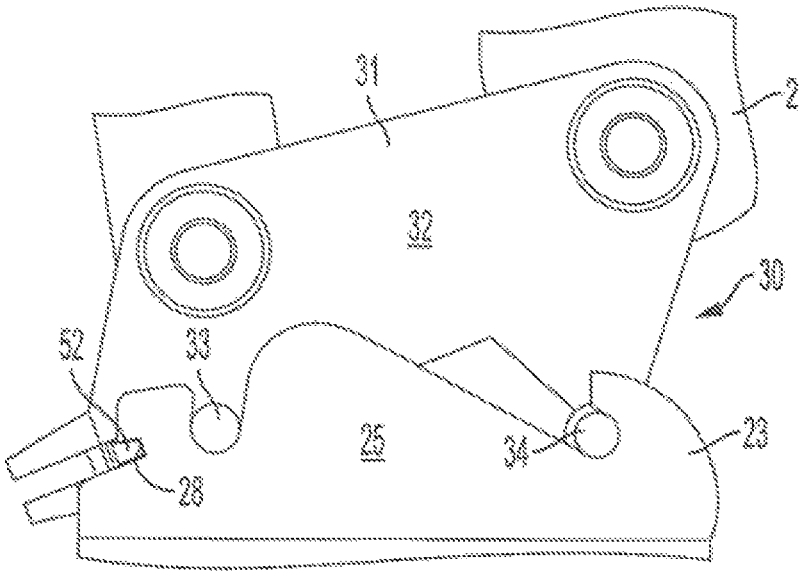
FIG. 4 is a side view of the tool of received in the mounted position on the coupling assembly with a retaining body of the coupling assembly in the retaining position.

Referring to FIGS. 1, 3 and 4, the tool 20 may be releasably mounted on the work machine 1 by manipulating the boom 3, the stick 2 and the mount 31 to position the mount 31 over the tool bracket 23 so that the rear lugs 34 are received in the rear recesses 27. Then, the mount 31 may be pivoted so that the front lugs 33 are received in the front recesses 26, whereby the tool 20 is received on the mount 31 in the mounted position as shown in FIG. 3. With the tool 20 in the mounted position, the retaining body 50 is then moved by a first actuator assembly 60 and a second actuator assembly 61, as further described below, from the release position as shown in FIG. 3 to the retaining position as shown in FIG. 4.

The first retaining portion 51 and the second retaining portion 52 are configured, in the retaining position of the retaining body 50, to retain the tool in the mounted position, and in the release position of the retaining body, to release the tool from the mounted position. The first retaining portion 51 and the second retaining portion 52 may engage fittingly, each in a respective one of the wedge receptacles 28 of the tool bracket 23 to prevent the tool bracket 23 from rotating relative to the mount 31. Thus, in combination with the front lugs 33, the rear lugs 34, and other contact surfaces, the first retaining portion 51 and the second retaining portion 52 retain the tool 20 in the mounted position, as shown in FIG. 4.

The retaining body 50 is pivotably connected to the mount 31 at a pivot axis X2 arranged between the first retaining portion 51 and the second retaining portion 52. The pivot axis X2 may be located mid-way between the first retaining portion 51 and the second retaining portion 52 when considered in the length direction of the retaining body 50.

The retaining body 50 is movable in translation relative to the mount 31 along a translation axis X3 which is acollinear (which is to say, not collinear) with the pivot axis X2 between the release position and the retaining position, as shown respectively in FIGS. 8 and 9. The translation axis X3 may be collinear with the longitudinal central axis X1 of the mount 31. The pivot axis X2 may be normal to the translation axis X3 and may intersect the translation axis X3, as shown.

Figure 10:
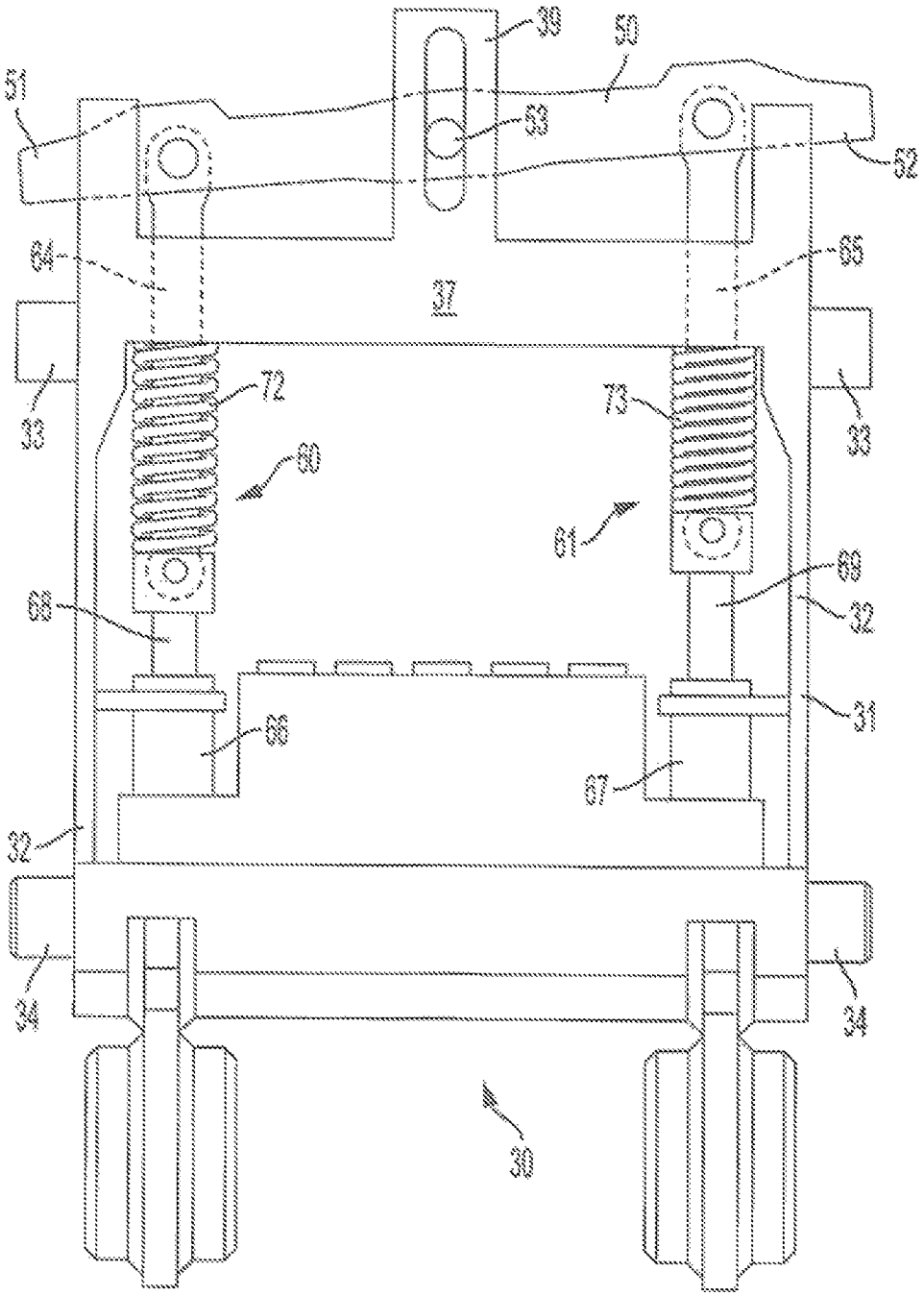
FIG. 10 is a bottom view of the coupling assembly showing the retaining body in a rotated position.
Figure 11:
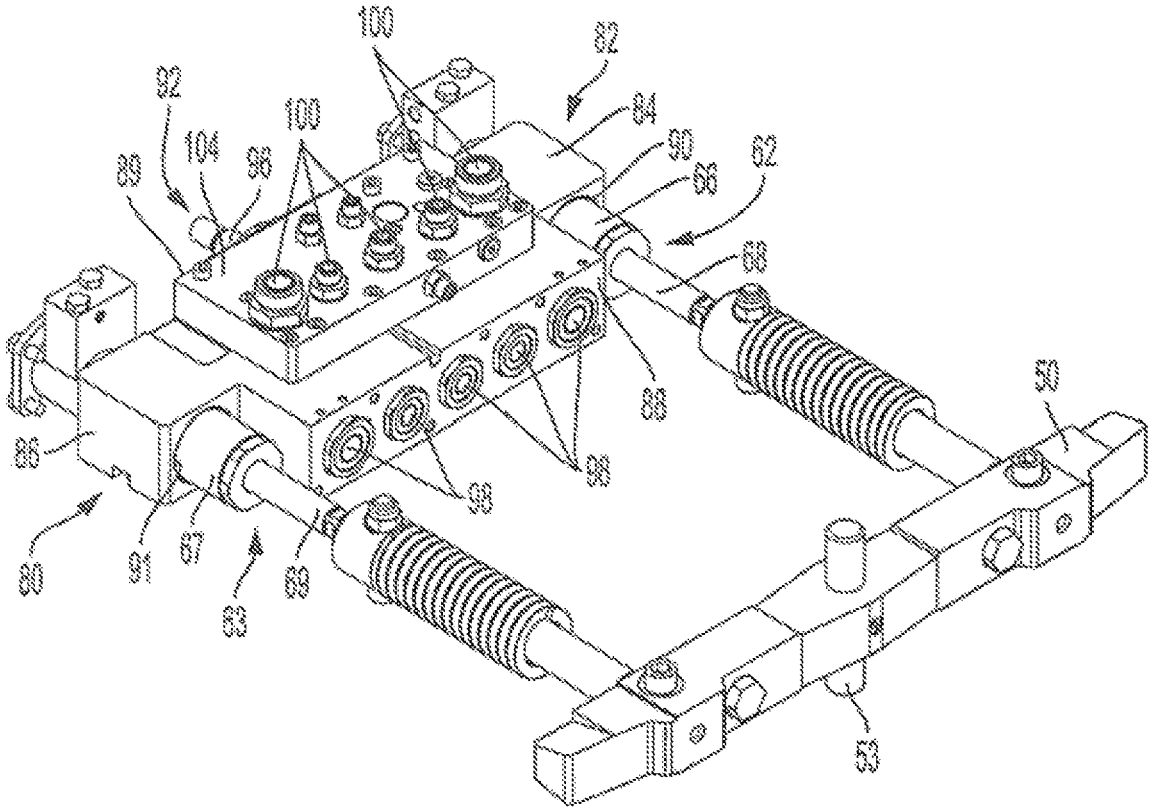
FIG. 11 is a partial perspective view of the coupling assembly.

The retaining body 50 is pivotable about the pivot axis X2 relative to the mount 31 when the pivot axis X2 is positioned along the translation axis X3 anywhere in a range of movement in-between the retaining and release positions, as shown in FIG. 10. In the retaining position the first retaining portion 51 and the second retaining portion 52 are clamped by the first actuator assembly 60 and the second actuator assembly 61 (to the mount 31 and/or to the tool bracket 23) so that the retaining body 50 is fixed relative to the mount 31 to retain the tool 20 in the mounted position.

The pivot axis X2 may be fixed relative to the retaining body 50 and movable in translation relative to the mount 31 along the translation axis X3 by movement of the retaining body 50 between the retaining and release positions. As shown in the illustrated embodiment, this may be achieved by providing an axle 53, which may be a solid (optionally, cylindrical) body fixed to the retaining body 50 to extend outwardly from one or, as illustrated, from both of its opposite (upper and lower) sides, so that the central axis of the axle 53 defines the pivot axis X2.

In this specification, an "axle" means a shaft or pin, for example, a trunnion or a pair of oppositely directed collinear trunnions, that defines a pivot axis about which the retaining body 50 can rotate at least through a limited angular range. The axle 53 is slidably guided for translation between third guide surfaces 43 defined by slots 42 formed in first portion 38 and the opposed second portion 39 of the mount 31. The middle region of the retaining body from which the axle 53 extends may be slidably received between the second upper guide surface 40 and the second lower guide surface 41 of the mount 31, which may be generally normal to the third guide surfaces 43 of the slots 42.

Thus, the retaining body 50 may both pivot and translate in the same plane while the third guide surfaces 43 constrain its translation at the position of the pivot axis X2 to one degree of freedom (along the translation axis X3) in the plane, and the first upper and lower guide surfaces 35, 36 and the second upper and lower guide surfaces 40, 41 prevent the retaining body 50 from moving out of the plane.

The first actuator assembly 60 and the second actuator assembly 61 include a first actuator 62 and a second actuator 63, respectively. The first actuator 62 and the second actuator 63 are provided for moving the retaining body 50 between the retaining and release positions. The first and second actuator assemblies 60, 61 and the first and second actuators 62, 63 may be arranged respectively at first and second sides of the mount 31, in parallel, as shown in FIGS. 8-10.

The first actuator assembly 60 is pivotably connected to a first region 54 of the retaining body 50 between the first retaining portion 51 and the pivot axis X2, while the second actuator assembly 61 is pivotably connected to a second region 55 of the retaining body 50 between the second retaining portion 52 and the pivot axis X2.

As exemplified by the illustrated embodiment, the first and second actuator assemblies 60, 61 may include, respectively, a first rigid connector 64 and a second rigid connector 65. The first rigid connector 64 is pivotably connected to the first actuator 62 and pivotably connected to the first region 54 of the retaining body 50, while the second rigid connector 65 is pivotably connected to the second actuator 63 and pivotably connected to the second region 55 of the retaining body 50.

The pivot connection at each end of each of the rigid connectors 64, 65 allows a static part of each of the actuators 62, 63 to be mounted in fixed relation to the mount 31 while decoupling each of the actuators 62, 63 from a bending moment resulting from torque applied by external forces acting on the first and second retaining portions 51, 52. In alternative embodiments, however, the actuators 62, 63 may be connected via a differently configured linkage to the retaining body 50.

In the illustrated embodiment, the first actuator 62 and the second actuator 63 are configured as hydraulic cylinders. In other embodiments, however, the first and second actuators 62, 63 may be any suitable actuator. The first actuator 62 include a first tube portion 66 and first piston-rod assembly 68 arranged within the first tube portion 66 to form a head-end pressure chamber and a rod-end pressure chamber. Likewise, the second actuator 63 includes a second tube portion 67 and a second piston-rod assembly 69 arranged within the second tube portion 67 to form a head-end pressure chamber and a rod-end pressure chamber. The pressure chambers may be selectively supplied with pressurized fluid and drained of the pressurized fluid to cause the first and second piston-rod assemblies 68, 69 to displace within the first and second tube portions 66, 67, respectively, thereby changing the effective length of actuators 62, 63.

The first and second piston-rod assemblies 68, 69 are pivotably connected, respectively to the first and second regions 54, 55 of the retaining body 50 via respective, first and second linkages, which may comprise first and second, rigid connectors 64, 65, for example as shown, while the first and second tube portions 66, 67 forming the static parts of the first and second actuators 62, 63, respectively, are mounted in fixed relation to the mount 31.

As shown in FIG. 9, the first tube portion 66 includes a first cylindrical exterior surface 70 and the second tube portion includes a second cylindrical exterior surface 71. Each of the first cylindrical exterior surface 70 and the second cylindrical exterior surface 71 are free of, or mostly free of, exterior fittings and hydraulic lines.

The first actuator assembly 60 may include a first resilient bias element 72, and the second actuator assembly 61 may include a second resilient bias element 73. The first and second resilient bias elements 72, 73 may be any suitable bias elements, such as for example, a coil spring. The first and second resilient bias elements 72, 73 are arranged to urge the first and second retaining portions 51, 52, respectively, towards the engaged position of the retaining body 50.

The forward end of each of the first and second bias element 72, 73 may bear against the central portion 37 at the forward end of the mount 31 while the rigid connectors 64, 65 pass through apertures in the central portion 37 of the mount 31 to connect pivotably with the retaining body 50. Each of the apertures is dimensioned to accommodate the angular displacement of the respective rigid connector 64, 65 as the retaining body 50 pivots under torque, as shown in FIG. 10.

As shown in FIGS. 8-11, the coupling assembly 30 includes a hydraulic coupling manifold 80. The hydraulic coupling manifold 80 may be configured in a variety of ways. Any hydraulic coupling manifold 80 that can be arranged on the mount 31 between the first and second actuator assemblies 60, 61 and use the first and second actuator assemblies 60, 61 as a guide for hydraulically coupling to the hydraulic power transmission coupling 24 on the tool 20 may be used. The hydraulic coupling manifold 80 can move between a coupling position, in which the tool 20 is hydraulically coupled to the work machine 1, and a decoupling position, in which the tool 20 is hydraulically decoupled from the work machine 1.

In the illustrated embodiment, the hydraulic coupling manifold 80 has a generally rectangular manifold body 82 that extends between the first and second actuator assemblies 60, 61. In other embodiments, however, the manifold body 82 can be any suitable size and shape. In the illustrated embodiment, the manifold body 82 includes a first end portion 84, a second end portion 86 opposite the first end portion 84, a front face 88 extended between the first end portion 84 and second end portion 86 and facing the retaining body 50, and a rear face 89, opposite the front face 88 and extended between the first end portion 84 and second end portion 86.

The hydraulic coupling manifold 80 is configured to be movable in translation relative to the mount in the direction of the translation axis X3. In the illustrated embodiment, the hydraulic coupling manifold 80 moves in the same plane as the retaining body 50. In other embodiments, the hydraulic coupling manifold 80 may not move coplanar with the retaining body 50. The hydraulic coupling manifold 80 uses the first and second actuator assemblies 60, 61 as a guide for movement between the coupled position (FIG. 14) and the decoupling position (FIG. 8). The coupled position refers to the position in which the hydraulic coupling manifold is hydraulically coupled to the hydraulic power transmission coupling 24. The decoupled position refers to the position in which the hydraulic coupling manifold is not coupled to the hydraulic power transmission coupling 24. In some embodiments, the decoupling position refers to a fully retracted position of the hydraulic coupling manifold. The hydraulic coupling manifold 80 can be configured to use the first and second actuator assemblies 60, 61 as a guide in a variety of ways.

In the illustrated embodiment, the first end portion 84 includes a first passage 90 configured to receive the first actuator 62 and the second end portion 86 includes a second passage 91 configured to receive the second actuator 63. In the illustrated embodiment, the first passage 90 circumferentially surrounds the first exterior surface 70 of the first actuator 62 and the second passage 91 circumferentially surrounds the second exterior surface 71 of the second actuator 63. In other exemplary embodiments, the first and second passages 90, 91 may only partially surround the first exterior surface 70 and the second exterior surface 71, respectively.

The hydraulic coupling manifold 80 may include a friction-reducing interface between the first exterior surface 70 of the first actuator 62 and the first passage 90 and a friction-reducing interface between the second exterior surface 71 of the second actuator 63 and the second passage 91. Any suitable friction-reducing interface may be used, such as a lubricated bushing, a roller bearing, or other friction-reducing interface. In one embodiment, the friction-reducing interface is a grease bushing (not shown) and the hydraulic coupling manifold 80 may include one or more grease zerks for supplying grease to the bushings.

Figure 12:
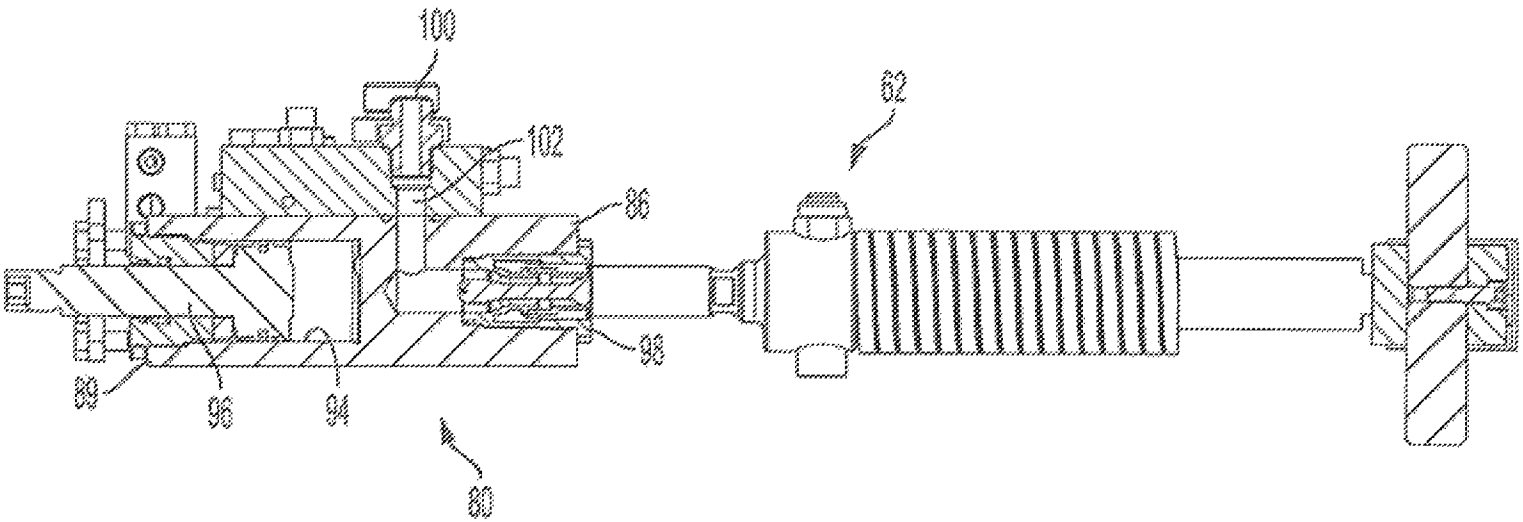
FIG. 12 is a side section view of the coupling assembly of FIG. 11.
Figure 13:
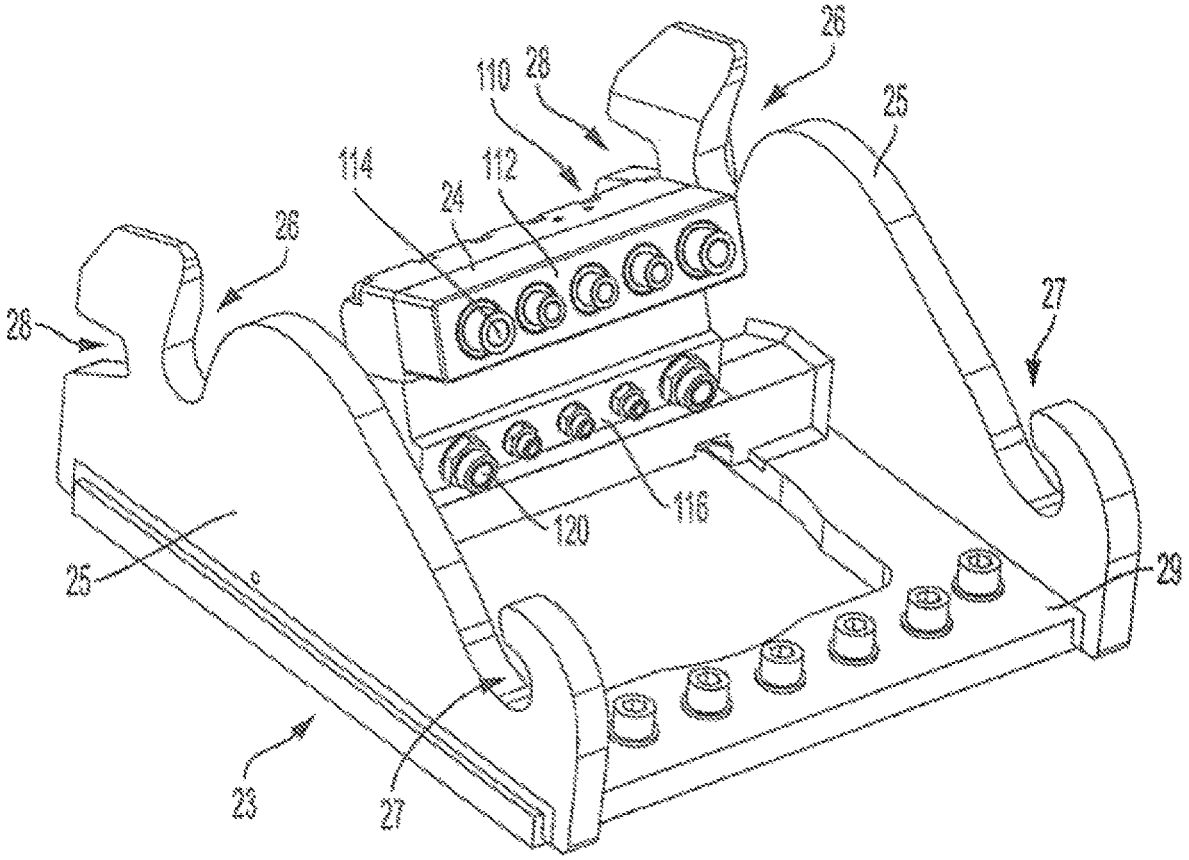
FIG. 13 is a perspective view of a bracket and hydraulic power transmission of the tool.

As shown in FIG. 12, the coupling assembly 30 includes a third actuator 92 associated with the hydraulic coupling manifold 80. The third actuator 92 is configured to move the hydraulic coupling manifold 80 between the coupled and decoupling positions. The third actuator 92 may be configured in a variety of ways. Any suitable actuator may be used. In the illustrated embodiment, the third actuator 92 is a hydraulic cylinder.

The third actuator 92 may be formed integrally with the manifold body 82, as shown in FIG. 12, or may be separate from the manifold body 82. In the illustrated embodiment, the manifold body 82 forms a cylindrical cavity 94 and a third piston-rod assembly 96 is arranged within the cylindrical cavity 94 to form a head-end pressure chamber and a rod-end pressure chamber. The third piston-rod assembly 96 includes a distal end 97 that extends outward of the rear face 879 of the manifold body and is fixably attached to a fixed surface (not shown), such as a portion of the rigid mount 31 or a surface attached to the rigid mount 31. The distal end 97 may be fixably attached in any suitable manner, such as for example, a threaded connection.

Selectively supplying one of the pressure chambers with pressurized fluid and draining pressurized fluid from the other chamber causes the third piston-rod assembly 96 to displace within the cylindrical cavity 94 thereby changing the effective length of third actuator 92. Since the distal end 97 is fixed relative to the rigid mount 31, supplying the head-end pressure chamber with pressurized fluid while draining pressurized fluid from the rod-end pressure chamber, moves the hydraulic coupling manifold 80 towards the retaining body 50 and the hydraulic power transmission coupling 24. Likewise, supplying the rod-end pressure chamber with pressurized fluid while draining pressurized fluid from the head-end pressure chamber, moves the hydraulic coupling manifold 80 away from the retaining body 50 and the hydraulic power transmission coupling 24.

The hydraulic coupling manifold 80 includes one or more hydraulic quick connectors 98. The one or more hydraulic quick connectors 98 may be configured in a variety of ways. For example, any suitable type, number, size, orientation, and arrangement of the one or more hydraulic quick connector 98 may be used. In the illustrated embodiment, the hydraulic coupling manifold 80 includes five, female hydraulic quick connectors 98 arranged horizontally in-line across the front face 88 of the manifold body 82. In other embodiments, the hydraulic coupling manifold 80 may include more or less than five hydraulic quick connectors 98, the hydraulic quick connectors 98 may be male connectors, and/or the hydraulic quick connectors 98 may be arranged other than horizontally in-line.

The hydraulic coupling manifold 80 includes hydraulic fluid inlets 100 and flow passages 102 connecting the hydraulic fluid inlets 100 to the hydraulic quick connectors 98. The hydraulic fluid inlets 100 are in fluid communication with the hydraulic pump 8 to supply hydraulic fluid through the hydraulic quick connectors 98. In the illustrated embodiment, hydraulic fluid inlets 100 are located on a top side 104 of the manifold block and the flow passages 102 are formed, generally, as 90-degree elbows. In other embodiments, however, the hydraulic fluid inlets 100 may be positioned at any suitable location on the hydraulic coupling manifold 80 and the flow passages 102 may be configured in any suitable manner to fluidly connect the hydraulic fluid inlets 100 to the hydraulic quick connectors 98.

Referring to FIGS. 2 and 12, the hydraulic power transmission coupling 24 on the tool 20 is configured and positioned to couple to the hydraulic coupling manifold 80. The hydraulic power transmission coupling 24 may be configured in a variety of ways. Any configuration that can hydraulically couple to a corresponding hydraulic coupling manifold 80 associated with the coupling assembly 30 may be used. In the illustrated embodiment, the hydraulic power transmission coupling 24 is fixably mounted onto the tool bracket 23 at an angle α that is aligned with the translation axis X3 of the coupling assembly 30 when the coupling assembly 30 is attached to the tool 20, as shown by line A in FIG. 2. In the illustrated embodiment, the angle α may be in the range of 10 degrees to 30 degrees relative to the base 29, such as for example, 15 degrees to 25 degrees, or about 20 degrees.

The hydraulic power transmission coupling 24 includes a transmission body 110 including an upper rear face 112 and one or more hydraulic quick connectors 114 positioned on the upper rear face 112. The one or more hydraulic quick connectors 114 are configured to couple to the one or more hydraulic quick connectors 98 on the hydraulic coupling manifold 80. Therefore, the while one or more hydraulic quick connectors 114 may be configured in a variety of ways, such as for example, any suitable type, number, size, orientation, and arrangement of the one or more hydraulic quick connector 114, the one or more hydraulic quick connectors 114 must be complementary to the one or more hydraulic quick connectors 98 on the hydraulic coupling manifold 80. In the illustrated embodiment, the hydraulic power transmission coupling 24 includes five, male hydraulic quick connectors 114 arranged horizontally in-line across the upper rear face 112 of the transmission body 110 to connect to the corresponding five, female hydraulic quick connectors 98 on the hydraulic coupling manifold 80.

The hydraulic power transmission coupling 24 includes a lower rear face 116 and a plurality of hydraulic fluid outlets 120 located on the lower rear face 116. Flow passages (not shown) fluidly connect the hydraulic quick connectors 114 to the hydraulic fluid outlets 120 to route hydraulic fluid received by to the hydraulic quick connectors 114 to the hydraulic fluid outlets 120. In the illustrated embodiment, the hydraulic power transmission coupling 24 includes five horizontally in-line hydraulic fluid outlets 120 on the lower rear face 116, one for each corresponding male hydraulic quick connector 114.

Figure 15:
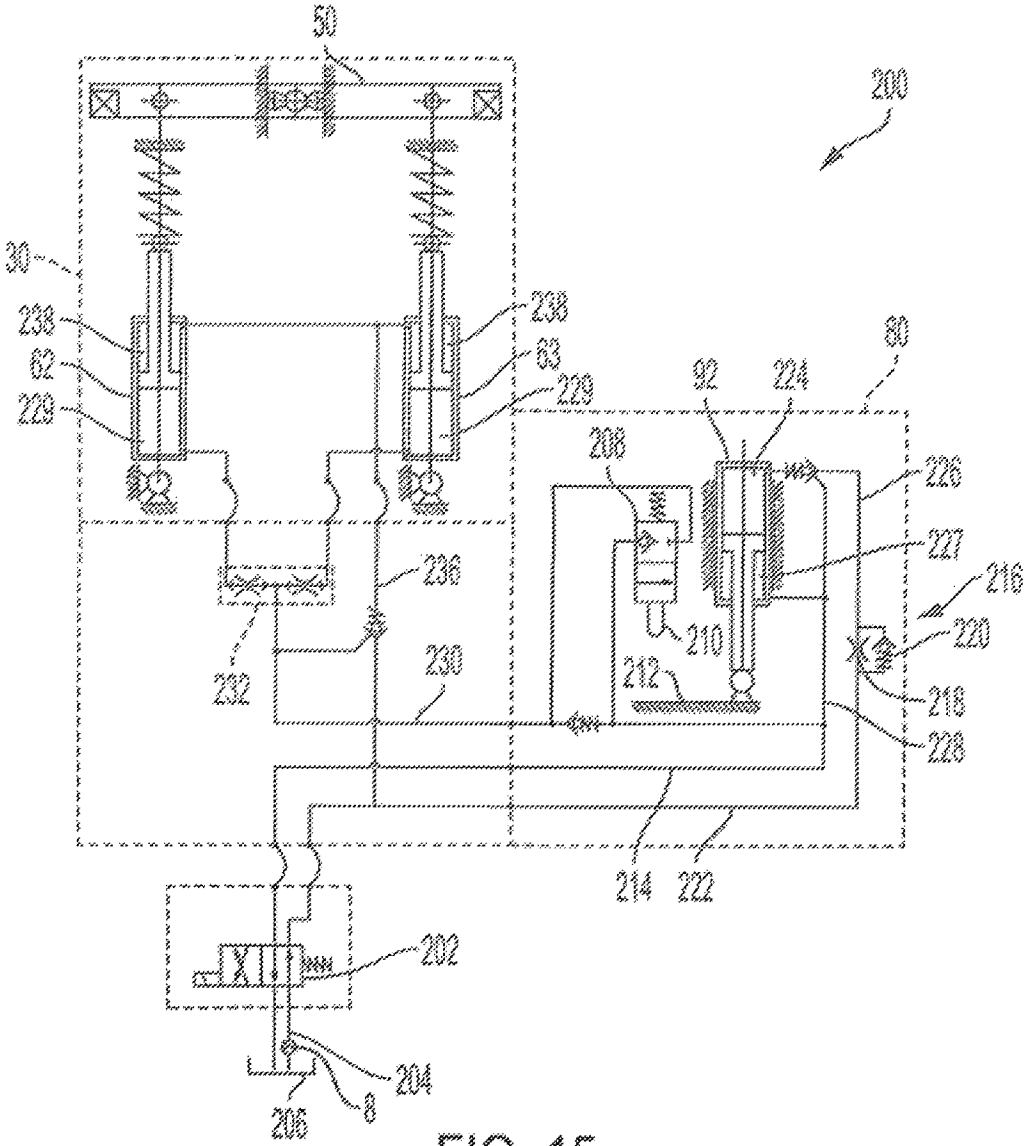
FIG. 15 is a schematic of a system for actuating the hydraulic coupling assembly and hydraulic coupling manifold.

FIG. 15 is a schematic of an exemplary system 200 according to the present disclosure for releasably mounting, and hydraulically coupling, the tool 20 to a work machine 1. FIG. 15 shows the system 200 with the coupling assembly 30 attached to the work machine 1.

The system 200 may be configured in a variety of ways. In the illustrated embodiment, the system 200 includes a first control valve 202. The first control valve 202 may be configured in a variety of ways. In the illustrated embodiment, the first control valve 202 is a four-way, two position solenoid valve located on the work machine 1. The first control valve 202 is in fluid communication with the hydraulic pump 8 via a first fluid conduit 204 to receive pressurized hydraulic fluid from the hydraulic pump 8. The hydraulic pump is in fluid communication with a source of hydraulic fluid, such as for example, a hydraulic fluid reservoir 206.

The system 200 includes a second control valve 208 that is configured to change states when the hydraulic coupling manifold 80 reaches the decoupling position or leaves the decoupling position. The second control valve 208 may be configured in a variety of ways. In the illustrated embodiment, the second control valve 208 is a two-way, two position, mechanically actuated solenoid valve. In the illustrated embodiment, the second control valve 208 is located on the coupling assembly 30 to move in translation with the hydraulic coupling manifold 80.

An actuating member 210, such as a plunger, stylus, lever, or other actuating element, on the second control valve 208 contacts a contact surface 212, such as a fixed surface, when the hydraulic coupling manifold 80 reaches the decoupling position. Upon sufficient contact with the contact surface 212, the actuating member 210 is displaced and the second control valve 208 changes from a closed state in which hydraulic fluid is prevented from flowing through the second control valve 208 to an open state in which hydraulic fluid is allowed to flow through the second control valve 208. When the hydraulic coupling manifold 80 leaves the decoupling position and moves toward the coupled position, the actuating member 210 is biased to return to its undisplaced position and the second control valve 208 changes from the open state to the closed state.

In other embodiments, however, the second control valve 208 may be configured and/or arranged differently. For example, the second control valve 208 may be fixed and the contact surface 212 may be configured to move in translation with the hydraulic coupling manifold 80 and displace the actuating member 210 when the hydraulic coupling manifold 80 reaches the decoupling position. The second control valve 208 is in fluid communication with the first control valve 202 via a second fluid conduit 214.

The system 200 includes a control element 216 that is configured to prevent the hydraulic coupling manifold 80 from moving from the decoupling position unless the retaining body 50 is in the retaining position. The control element 216 may be configured in a variety of ways. In the illustrated embodiment, the control element 216 includes a flow restrictor 218 arranged in a parallel with a check valve 220. In other embodiments, however, the control element 216 may be configured differently. For example, the control element 216 may include a valve that opens in response to hydraulic pressure reaching a threshold value or other suitable trigger associated with the retaining body reaching the retaining position.

The control element 216 is in fluid communication with the first control valve 202 via a third fluid conduit 222 and in fluid communication with a head-end pressure chamber 224 of the third actuator 92 via a fourth fluid conduit 226. A rod-end pressure chamber 227 of the third actuator 92 is in fluid communication with the second fluid conduit 214 via a fifth fluid conduit 228.

As shown in FIG. 15, the second control valve 208 is in fluid communication with the head-end pressure chambers 229 of the first actuator 62 and the second actuator 63 via a sixth fluid conduit 230. The flow divider 232 may be located in the sixth fluid conduit 230 to split the hydraulic flow in the sixth fluid conduit 230 evenly between the first actuator 62 and the second actuator 63 such that the first and the second actuators 62, 63 move in unison. A seventh fluid conduit 236 connects the rod-end pressure chambers 238 of the first actuator 62 and the second actuator 63 to the third fluid conduit 222.

In alternative embodiments, the various actuators may be either electrically or hydraulically operated. The mount, retaining body, actuator assemblies and other components of the novel coupling assembly may be configured differently to those illustrated. The retaining body may be pivotably connected to the mount either directly or indirectly, for example, via a suitable linkage that guides it in translation.

All of the various hydraulic, electrical or other power supply and control functions may be connected to the hydraulic pump 8 or other hydraulic, electrical or mechanical power supply of the work machine 1 and operated by the operator of the work machine 1 responsive to input via the user controls 9.

INDUSTRIAL APPLICABILITY

The novel coupling assembly may be used with any suitable work machine and any suitable hydraulically-powered tool. In the illustrated embodiment, by attaching the actuator assemblies to the first and second regions of the retaining body, the actuators can be arranged towards the sides of the mount to provide open space between them to accommodate the hydraulic coupling manifold. Having the hydraulic coupling manifold positioned in the interior of the coupling assembly between the actuators and the side plates results in the hydraulic coupling manifold being less vulnerable to being damaged during operation than an externally mounted hydraulic coupling arrangement. The coupling assembly uses the actuators as guides for movement, thus not requiring other guide structure to be included in the coupling assembly. The hydraulic coupling manifold utilizes one or more quick connects for easy and reliable automatic connections when the hydraulic coupling manifold is moved into engagement with the hydraulic power transmission coupling on the tool. The quick connects are arranged horizontally in-line and the hydraulic coupling manifold is actuated by an integrated hydraulic cylinder resulting in a thin profile for the hydraulic coupling manifold that fits conveniently between to actuators and side plates. By using the actuators as guides, the hydraulic coupling manifold moves in the same horizontal plane as the retaining member.

Figure 14:
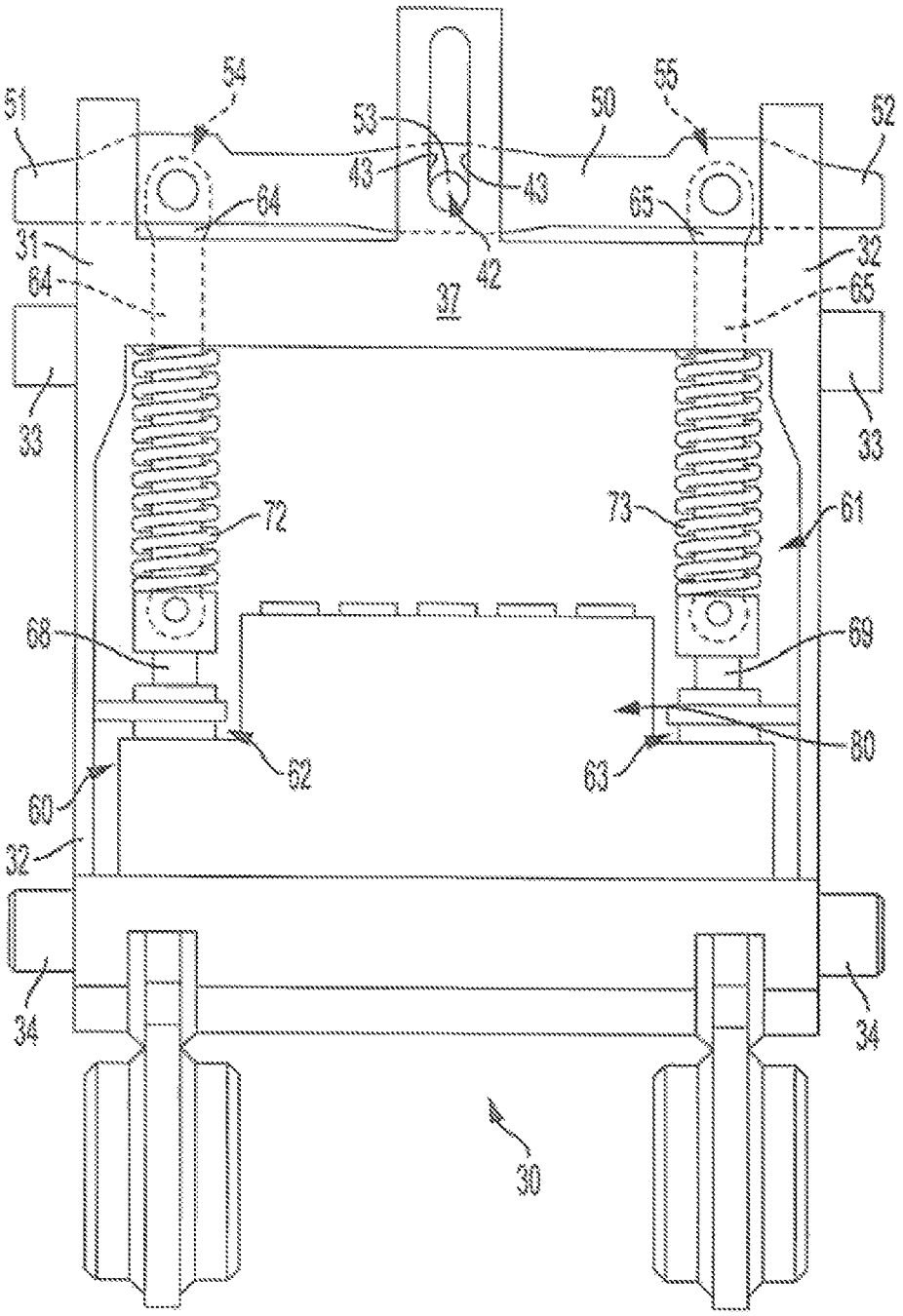
FIG. 14 is a bottom view of the coupling assembly showing the hydraulic coupling manifold in an extended position.
Figure 16:
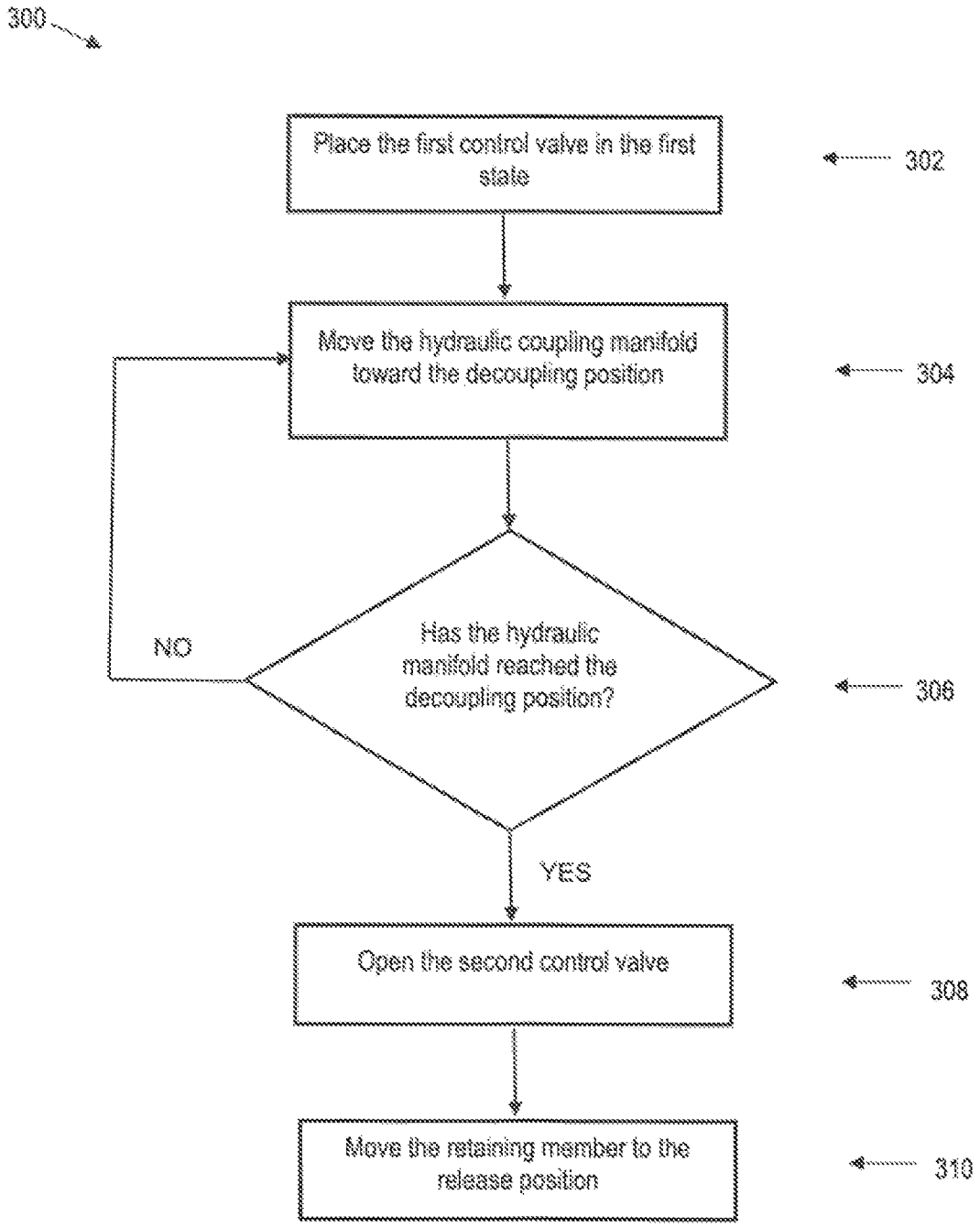
FIG. 16 is a flow chart illustrating an exemplary method of decoupling a tool from a work machine.

In operation, with the tool 20 coupled to the machine 1, the retaining body 50 is in the retaining position and the hydraulic coupling manifold 80 is in the coupling position (as shown in FIG. 14). Referring to FIG. 16, a method 300 of decoupling the tool 20 from the machine 1 includes the step 302 of placing the first control valve 202 to a first state in which pressurized hydraulic fluid from the hydraulic pump 8 is routed through the second fluid conduit 214. Pressurized hydraulic fluid in the second fluid conduit flows into the rod-end pressure chamber 227 of the third actuator 92 causing the hydraulic coupling manifold 80 to move toward its decoupling position, in step 304.

As the third actuator 92 moves the hydraulic coupling manifold 80 toward decoupling position, the hydraulic fluid in the head-end pressure chamber 224 is returned to the hydraulic fluid reservoir 206 via the third fluid conduit 222. In step 306, the system senses whether the hydraulic coupling manifold 80 has reached the decoupling position. If the hydraulic coupling manifold 80 is not in, or has not yet reached, the decoupling position, the second control valve 208 remains in a closed state preventing pressurized hydraulic fluid from flowing into sixth fluid conduit 230 and actuating the first and second actuators 62, 63.

In step 308, once the hydraulic coupling manifold 80 reaches the decoupling position, the second control valve 208 is opened. For example, the fixed contact surface 212 displaces the actuating member 210 causing the second control valve 208 to open. When the second control valve 208 opens, pressurized hydraulic fluid will flow from the second fluid conduit 214, through the second control valve 208, through the sixth fluid conduit 230, and into the head-end pressure chambers 229 of the first and second actuators 62, 63. As a result, in step 310, the first and second actuators 62, 63 will extend to move the retaining body 50 to the release position allowing the tool 20 to be released from the work machine 1.

Figure 17:
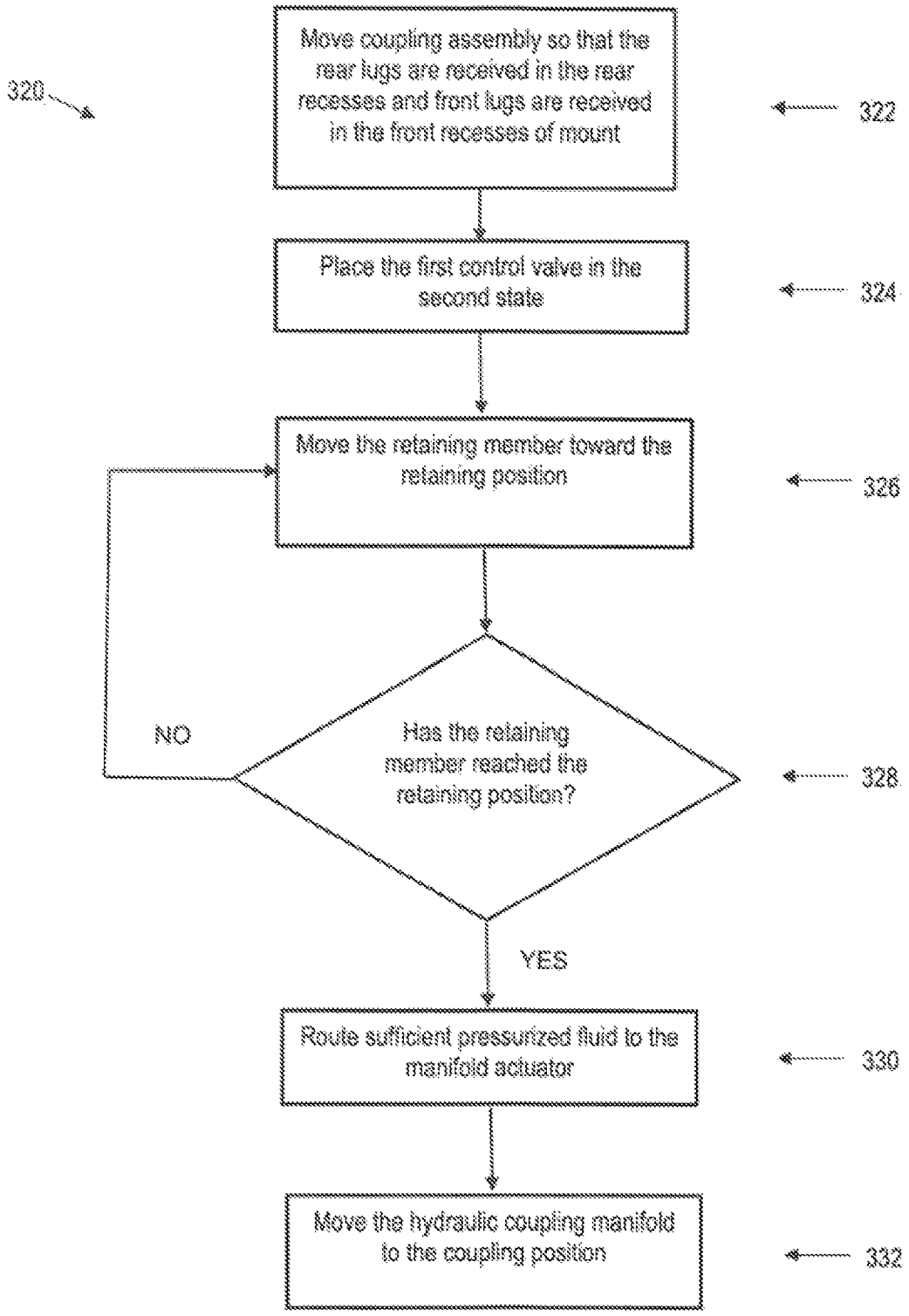
FIG. 17 is a flow chart illustrating an exemplary method of coupling a tool to a work machine.

Referring to FIG. 17, a method 320 for coupling a different tool, or recoupling the same tool 1, includes the step 322 of moving the mount 31 to a position over the tool bracket 23 so that the rear lugs 34 are received in the rear recesses 27. Then, the mount 31 may be pivoted so that the front lugs 33 are received in the front recesses 26, whereby the tool 20 is received on the mount 31 in the mounted position as shown in FIG. 3.

With the tool 20 in the mounted position, and the first control valve 202 is placed in a second state in step 324. In the second state, pressurized hydraulic fluid from the hydraulic pump 8 is routed through the third fluid conduit 222 and the sixth fluid conduit 230. The pressurized fluid in the sixth fluid conduit 230 is routed to the rod-end pressure chambers 238 of the first and second actuators 62, 63 to move the retaining body 50 toward the retaining position, in step 326. As the first and second actuators 62, 63 move the retaining body 50 toward the retaining position, the hydraulic fluid in the head-end pressure chamber 229 is returned to the hydraulic fluid reservoir 206 via the sixth fluid conduit 230 and the second fluid conduit 214.

Since the third fluid conduit 222 includes the control element 216, the flow of pressurized hydraulic fluid to the head-end pressure chamber 224 of the third actuator 92 is restricted or prevented such that while the first and second actuators 62, 63 are moving the retaining body 50 toward the retaining position, the third actuator 92 will not actuate. Thus, the system is configured to determine if the retaining member has reached the retaining position, in step 328. Once the retaining body 50 reaches the retaining position, the control element 216 is configured to allow sufficient pressurized hydraulic fluid into the head-end pressure chamber 224 of the third actuator 92, in step 330. Routing sufficient pressurized hydraulic fluid into the head-end pressure chamber 224 of the third actuator 92 results in the third actuator 92 moving the hydraulic coupling manifold 80 toward the coupling position with the hydraulic power transmission coupling 24, in step 332.

Thus, the system 200 is configured to prevent movement of the retaining body 50 and the hydraulic coupling manifold 80 at the same time. In particular, when attaching the tool 20 to the work machine 1, the retaining body 50 moves to the retaining position before the hydraulic coupling manifold 80 begins moving to the coupling position. Similarly, when releasing the tool 1 from the work machine 1, the hydraulic coupling manifold 80 moves to the decoupling position before the retaining body 50 begins moving to the release position. In this way, the two-step connection procedure helps prevent unintended movement or deliberate misuse that may damage or destroy the components of the coupling assembly 30 or the tool 20.

Unless otherwise indicated herein, all sub-embodiments and optional embodiments are respective sub-embodiments and optional embodiments to all embodiments described herein. While the present disclosure has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the present disclosure, in its broader aspects, is not limited to the specific details, the representative compositions or formulations, and illustrative examples shown and described. Accordingly, departures may be made from such details without departing from the spirit or scope of Applicant's general disclosure herein.

What is claimed is:

1. A coupling assembly comprising:

a mount attachable to a work machine and configured to receive a tool in a mounted position of the tool;

a retaining body movable in translation relative to the mount along a translation axis between a retaining position for retaining the tool to the mount and a release position for releasing the tool from the mount;

a first actuator and a second actuator independently operable to move the retaining body between the retaining and release positions;

a hydraulic coupling manifold movable in translation relative to the mount along the translation axis between a coupling position that hydraulically couples the tool to the work machine and a decoupling position wherein the tool is hydraulically decoupled from the work machine, wherein the hydraulic coupling manifold uses the first and second actuators as guides for moving along the translation axis; and a control valve configured to prevent movement of the retaining body from the retaining position to the release position unless the hydraulic coupling manifold is in the decoupling position.

2. The coupling assembly of claim 1, further comprising a controller configured to prevent the hydraulic coupling manifold from moving from the decoupling position to the coupling position unless the retaining member is in the retaining position.

3. The coupling assembly of claim 2, wherein the controller includes a flow restrictor or a valve configured to actuate in response to hydraulic pressure exceeding a pressure threshold.

4. The coupling assembly of claim 1, wherein the control valve is mounted to move in translation with the hydraulic coupling manifold, and wherein the control valve includes an actuator that is displaced by contact with a contact surface responsive to the hydraulic coupling manifold reaching the decoupling position.

5. The coupling assembly of claim 1, further comprising a third actuator mounted within the hydraulic coupling manifold to move the hydraulic coupling manifold between the coupling position and the decoupling position.

6. A coupling assembly for releasably mounting, and hydraulically coupling, a tool to a work machine, comprising:

mounting means attachable to the work machine for receiving the tool in a mounted position of the tool;

retaining means that is movable in translation relative to the mounting means along a translation axis between a retaining position for retaining the tool to the mounting means and a release position for releasing the tool from the mounting means;

actuating means for moving the retaining means between the retaining and release positions;

coupling means movable in translation relative to the mounting means along the translation axis between a coupling position for hydraulically coupling the tool to the work machine and a decoupling position for hydraulically decoupling the tool from the work machine, wherein the coupling means uses the actuating means as guides for moving along the translation axis, and control means for preventing movement of the retaining means from the retaining position to the release position unless the coupling means is in the decoupling position.

7. The coupling assembly of claim 6, further comprising a control element for preventing the coupling means from moving from the decoupling position to the coupling position unless the retaining means is in the retaining position.

8. The coupling assembly of claim 7, wherein the control element includes a flow restrictor or a valve configured to actuate in response to hydraulic pressure exceeding a pressure threshold.

9. The coupling assembly of claim 6, wherein the control means is mounted to move in translation with the coupling means, and wherein the control means includes an actuating element that is displaced by contact with a contact surface responsive to the coupling means reaching the decoupling position.

10. The coupling assembly of claim 6, further comprising a second actuating means mounted within the coupling means for moving the coupling means between the coupling position and the decoupling position.

* * * * *